US006500306B2

(12) United States Patent
Malm

(10) Patent No.: US 6,500,306 B2
(45) Date of Patent: Dec. 31, 2002

(54) ARRANGEMENT WITH WHITE WATER CHANNEL

(75) Inventor: Jan Malm, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 09/876,370

(22) Filed: Jun. 7, 2001

(65) Prior Publication Data

US 2002/0060029 A1 May 23, 2002

Related U.S. Application Data

(60) Provisional application No. 60/244,945, filed on Nov. 1, 2000.

(30) Foreign Application Priority Data

Jun. 9, 2000 (SE) ..... 0002164

(51) Int. Cl.[7] ..... D21F 1/66
(52) U.S. Cl. ..... 162/264; 162/190
(58) Field of Search ..... 162/190, 264, 162/348

(56) References Cited

U.S. PATENT DOCUMENTS 1,620,860 A * 3/1927 Allen ..... 162/190
1,629,607 A * 5/1927 Witham ..... 162/264
1,670,874 A * 5/1928 Bankus et al. ..... 162/264
3,801,436 A 4/1974 Prechtel
6,200,417 B1 * 3/2001 Binder et al. ..... 162/264

FOREIGN PATENT DOCUMENTS

| | | |
|---|---|---|
| GB | 377 | 1/1898 |
| DE | 29916787 U1 | 12/1999 |
| GB | 2179073 A | 7/1986 |
| WO | WO 83/02293 | 12/1982 |
| WO | WO 93/23612 | 5/1993 |

* cited by examiner

*Primary Examiner*—Peter Chin
(74) *Attorney, Agent, or Firm*—Alston & Bird LLP

(57) ABSTRACT

An arrangement for handling white water from a paper machine comprises a white water channel having an inlet end for receiving white water from a paper machine and an opposite outlet end defining a main outlet through which the white water is discharged into a container. A channel bottom slopes downward and an additional outlet is provided between the main outlet and the inlet end, the bottom having a first bottom portion that leads away from the inlet end up to the additional outlet and a second bottom portion that leads away from the additional outlet toward the main outlet. The first and second bottom portions are so arranged in relation to each other that each of the bottom portions slopes downward in the flow direction at an angle of inclination that exceeds a critical angle of inclination that avoids sedimentation on the bottom.

19 Claims, 3 Drawing Sheets

VIEW A-A

ARRANGEMENT WITH WHITE WATER CHANNEL

CROSS-REFERENCE TO RELATED APPLICATION

The present application claims the benefit of the filing date of U.S. Provisional Patent Application No. 60/244,945 filed Nov. 1, 2000, which is incorporated herein by reference.

FIELD OF THE INVENTION

The present invention relates to an arrangement for the handling of white water from a paper machine, in which a channel is employed having an inlet end connected to an outlet for white water from a paper machine and having an outlet end that defines a main outlet for the white water to discharge into a container such as a white water silo. The invention relates more particularly to such an arrangement wherein the channel has a bottom that slopes downward in the flow direction with a certain angle of inclination relative to horizontal that is at least as great as a certain critical angle of inclination in order to avoid sedimentation on the channel bottom.

BACKGROUND OF THE INVENTION

In the wet end of a paper machine large amounts of water are drained from the pulp suspension or stock during formation of a fiber web. In very large machines the flow rate of this drained water can be 1 $m^3/s$. This liquid, commonly called white water, must be handled in a rational and cost-efficient manner. Typically, almost all of the white water is collected and is then recirculated for use in other parts of the papermaking process, such as for dilution, washing of the pulp, etc. It is necessary that the air content of the white water be relatively low in order to be able to reuse the white water.

Suitably, the removal of air is made in the simplest possible way, i.e., by giving the white water a sufficiently long period of time for the air bubbles to rise to the surface and thus be removed from the water before the water is reused. For this purpose, a so-called white water channel is provided in a paper machine. The channel has a certain length and width as well as a certain flow rate all of which are selected to give the desired deaeration. Normally, the flow rate in the white water channel should not exceed 0.5 m/s to obtain good deaeration. Further, it is important to avoid turbulence, as there is otherwise a risk that the air bubbles will rotate down into the water again. In order not to disturb the flow mode, sedimentation on the bottom of the white water channel should be avoided. To avoid such sedimentation, the white water channel is made to slope downward at a sufficient angle of inclination in the flow direction that fibers and other particles are carried to the outlet rather than settling on the bottom of the channel. Experience shows that the critical angle of inclination should be at least 2°, preferably at least 3°, in order to avoid sedimentation. In many installations, however, there is no possibility to provide the white water channel with a sufficiently large inclination, for instance when the height of the white water outlet from the paper machine is relatively low in combination with the white water silo being located at a large distance from the white water outlet of the paper machine. To address this problem, special cavities or recesses have been created in the machine floor of the plant on which the paper machine stands, so that sufficient inclination is obtained at the bottom of the channel that goes to the silo, which is located on a lower floor below the machine floor. In some cases, it has been necessary to remove essential portions of the machine floor in order to obtain sufficient inclination. It will be recognized that such a solution is not desirable from an economic point of view in that it is expensive to cut away concrete material and to construct a suitable channel arrangement therein. Furthermore, such a solution is not desirable from the standpoint of safety because the removal of part of the floor can affect the stability/safety of the building.

An arrangement in connection with a white water channel is disclosed in DE-29916787 U1, the purpose of which is to prevent admixture of air caused by whirls in the white water channel. The white water channel is divided into two entirely separate sections, which are located at different levels, one above the other. The white water can flow down from the upper section to the lower one through a plurality of outlet pipes located at different levels. Through this arrangement, the creation of whirls and hence admixture of air in the white water channel are said to be prevented. There are, however, several drawbacks with such an arrangement. Firstly, because of the division into different levels, this design requires special conditions as to the plant building in order to make it possible to employ such an arrangement at all. It is not always desirable that such an adaptation of the plant building should be made in order to eliminate air problems in the white water channel. Further, the design is likely to entail increased costs for outlets, etc., which is not desirable. Finally, it is uncertain whether such an arrangement would be effective for the removal of the small bubbles that are formed in connection with the paper web formation and that follow the white water into the white water channel. As already mentioned, there is an advantage if the many small bubbles that are formed in connection with the web formation are removed from the water before it is recirculated.

SUMMARY OF THE INVENTION

The present invention addresses the above needs and achieves other advantages, by providing an arrangement for handling white water from a paper machine, in which the critical angle of inclination of the white water channel can be achieved even when the running distance of the channel is relatively long considering the height difference between the paper machine's white water outlet and the main outlet of the channel. In accordance with one embodiment of the present invention, the arrangement comprises a white water channel having an inlet end for receiving white water from a paper machine and an opposite outlet end defining a main outlet through which the white water is discharged into a container, the channel having a channel bottom, the channel bottom sloping downward in a flow direction from the inlet end to the outlet end. In accordance with the invention, an additional outlet is provided between the main outlet and the inlet end, the bottom having a first bottom portion that leads away from the inlet end up to the additional outlet and a second bottom portion that leads away from the additional outlet toward the main outlet. The first and second bottom portions are so arranged in relation to each other that each of the bottom portions slopes downward in the flow direction at an angle of inclination that exceeds a critical angle of inclination that avoids sedimentation on the bottom.

The invention thus can eliminate the need to make changes in the existing floor surface on which the paper machine stands, and can reduce the cost of the construction.

Preferably, the additional outlet is formed through the bottom of the channel. It is further preferred that the first bottom portion slope downward from an upstream end to a downstream end thereof and the additional outlet is located substantially at the downstream end of the first bottom portion.

In accordance with another preferred embodiment of the invention, the second bottom portion slopes downward from an upstream end to a downstream end thereof, and the upstream end of the second bottom portion is at a higher vertical level than the downstream end of the first bottom portion.

A particularly preferred embodiment has the upstream ends of the first and second bottom portions located at substantially the same vertical level.

In another preferred embodiment, the bottom of the channel includes an intermediate bottom portion between the first and second bottom portions, the intermediate bottom portion sloping upward from a downstream side of the additional outlet to the upstream end of the second bottom portion. The intermediate bottom portion has an angle of inclination larger, and preferably substantially larger, than that of either of the first and second bottom portions, for example between 5° and 60°.

Each of the first and second bottom portions has an angle of inclination exceeding about 2°, more preferably exceeding about 2.5°, most preferably exceeding about 3°. The angles of inclination of the first and second bottom portions can be approximately equal.

In one embodiment of the invention, the bottom of the channel has a V-shaped configuration in transverse cross-section and the additional outlet is located at a lowest point of the transverse cross-section.

It is also within the scope of the invention for the channel to include a third bottom portion following the second bottom portion and also sloping downward in the flow direction with an angle of inclination exceeding the critical angle of inclination. In this case, a second additional outlet is formed in the channel between the inlet end and the main outlet.

BRIEF DESCRIPTION OF DRAWINGS

The invention will be described more in detail below with reference to the enclosed drawings, of which

DETAILED DESCRIPTION OF THE INVENTION

Figure 1:
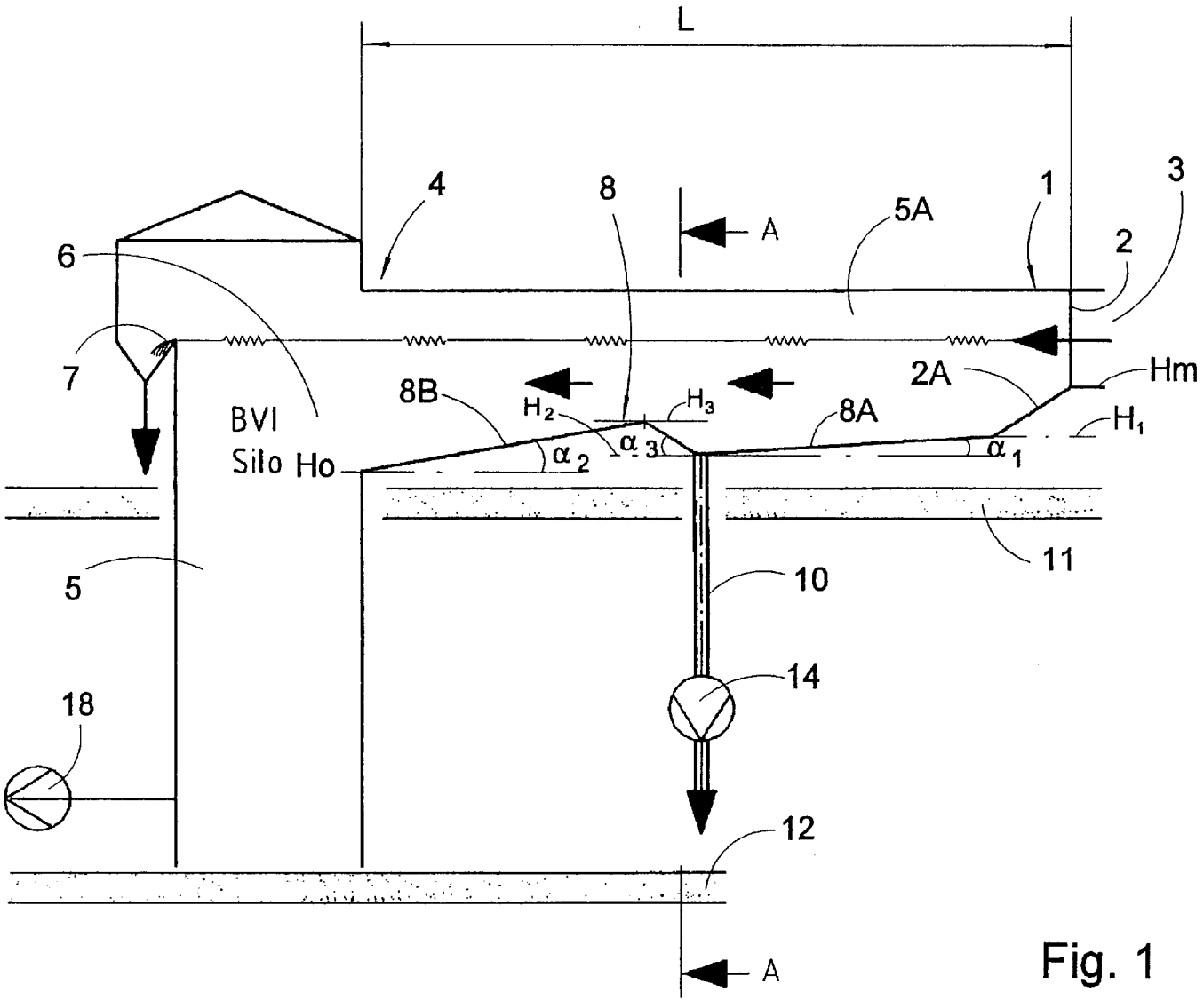
FIG. 1 shows the principles for an arrangement according to a preferred embodiment of the invention.

In FIG. 1 a preferred embodiment of a white water channel according to the invention is shown as well as the associated arrangement. An inlet end 1 of the channel is shown, which end is connected to a white water outlet 2 of a paper machine 3. The paper machine 3 is arranged on a machine floor 11, which constitutes a first floor level in the plant building. Below the machine floor 11 there is a bottom floor 12, on which a white water silo 5 is located. This silo is arranged at the outlet end 4 of the white water channel and receives white water through a main outlet 6 of the channel. A pump 18 is provided to pump and/or to mix dilution water and the stock that is carried to the head box (not shown). At the outlet end of the white water channel there is an overflow 7 to guarantee that the white water level is kept substantially constant. Substantially vertical side walls 5A, 5B are provided between the inlet end 1 and the outlet end 4. Further, the channel comprises a first bottom portion 8A and a second bottom portion 8B, which portions are inclined in the flow direction. The second bottom portion 8B connects at its downstream end to the main outlet 6 at a vertical level $H_0$, which substantially coincides with the level of the machine floor 11. The upstream end of the second bottom portion lies at a vertical level $H_3$ that makes the bottom portion slope at a certain angle in relation to the horizontal plane. According to the preferred embodiment, this angle $\alpha_2$ is about 3°. Between the two bottom portions 8A and 8B there is an additional outlet 9 to which an outlet pipe 10 is connected. A pump 14 is provided at the end of the outlet pipe 10 to pump the white water. Suitably, the pump 14 is included in the reject circulation, such that the drained liquid can be used for dilution of the reject pulp. Leading from the downstream side of the additional outlet 9 there is an intermediate bottom portion 8D, which is sloped upward in the flow direction at a relatively large angle $\alpha_3$ in relation to the horizontal plane. According to the preferred embodiment, the upstream end of the first bottom portion 8A is at a vertical level $H_1$ that is about the same level as the vertical level $H_3$ of the upstream end of the second bottom portion 8B, but as can be seen in the figure, the levels can be somewhat different and still maintain their functionality according to the invention. It should be observed that the level $H_3$ of the upstream end of the second bottom portion is not placed too high in relation to the liquid level in the white water channel, so that no detrimental turbulence can occur at this position. Normally, however, this risk does not exist, as the inclination is very small, which implies a low height of the construction.

As can be seen from the figure, a wall portion 2A is provided at the discharge end $H_m$ of the outlet of the paper machine, which wall portion is inclined at a large angle, preferably about 45°, downwards toward the upstream end of the first bottom portion 8A. The purpose of this steeply inclined wall portion 2A is to reduce the flow rate in the white water channel as rapidly as possible to provide a sufficiently low rate to avoid turbulence. Normally it is desired that the flow rate in the white water channel shall not exceed 0.5 m/s. The inclined bottom portions 8A, 8B have the same purpose, i.e., they slope to avoid or eliminate the establishment of turbulence in the white water channel. By using certain angles of inclination, $\alpha_1$, $\alpha_2$, in the flow direction, sediment is deterred from being deposited and built up on the bottom portions 8A, 8B. Using an angle of inclination of about 3° is normally sufficient to assure that sediment is not deposited but rather follows the white water flow towards the outlets 6, 9, 13. Because of the division of the bottom portion 8 into two sub-portions 8A, 8B, a sufficiently large inclination can be achieved even if the level difference between the bottom end $H_m$ of the outlet 2 of the machine and the lowest possible level $H_0$ of the main outlet 6 is too small in relation to the distance L therebetween. The larger the distance L is, the smaller is the maximum inclination angle that can be achieved for the channel bottom when the bottom extends in one straight run from the paper machine outlet 2 to the main outlet 6. Normally, the angle must at least exceed 2° in order to avoid sediment being deposited on the channel bottom. In many cases, as previously noted, a cutting of the existing machine floor 11 is necessary in order to obtain sufficient inclination downwards towards the silo. This has proved to be an undesirable solution, not the least from an economic point of view. The invention avoids having to cut the machine floor.

Figure 2:
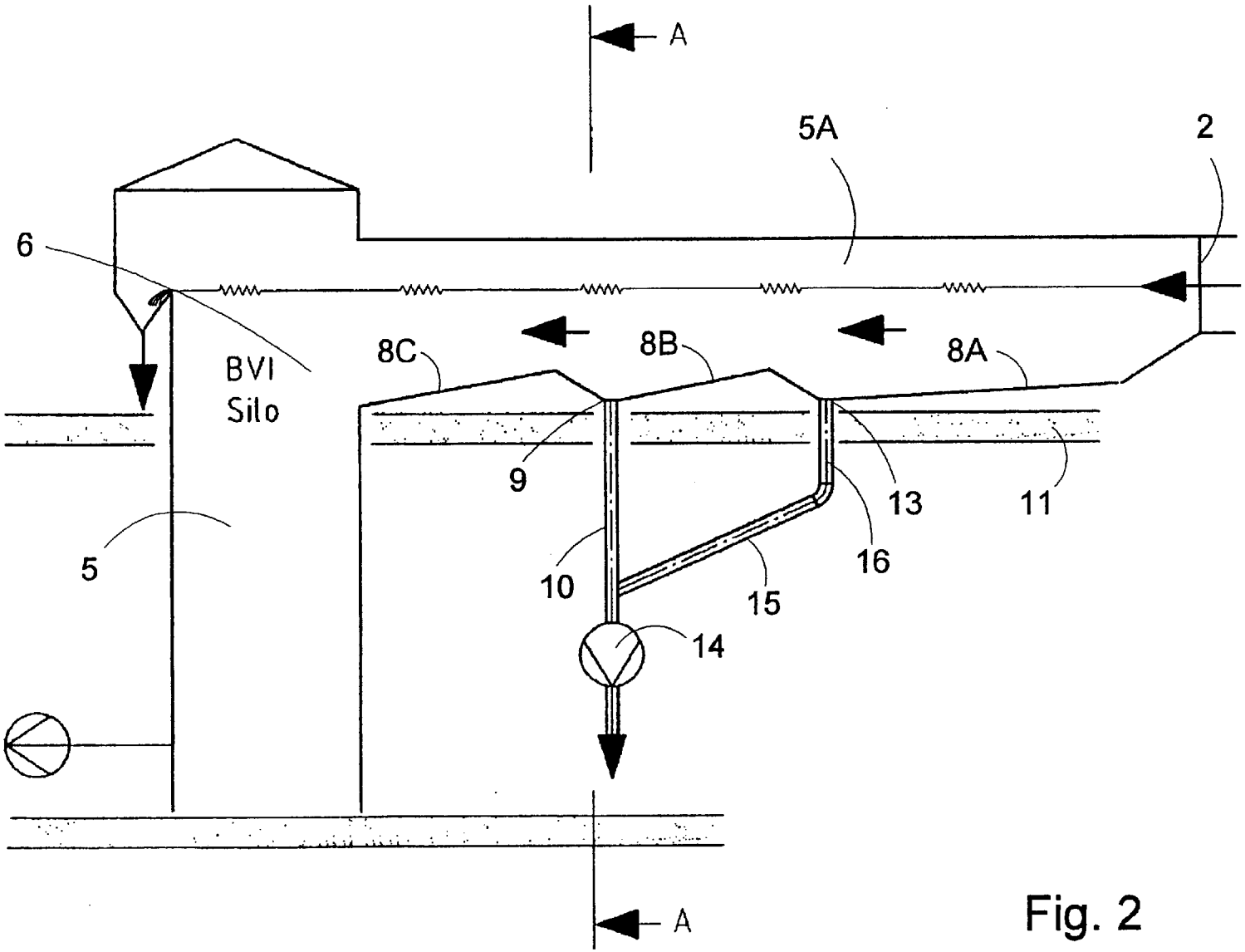
FIG. 2 shows an alternative embodiment according to the invention.

An alternative embodiment of the invention is shown in FIG. 2. As can be seen, the bottom portion 8 is divided into:three different bottom portions 8A, 8B, 8C. It can be seen that in FIG. 2 the height difference between the bottom end $H_m$ of the outlet of the machine 3 and the main outlet 6 is about the same as for the arrangement in FIG. 1, but the distance L from the paper machine outlet to the silo 5 is increased, thus exacerbating the problem of providing a sufficiently large inclination of the channel. However, a sufficient angle of inclination can be obtained when the bottom is divided into more than two sub-portions. In other respects the solution is in principle the same as described. above. A further modification, which is shown in FIG. 2, is that the two additional outlets 9, 13 are respectively connected to conduits 10, 16, which conduits are connected to each other through a connection conduit 15, which preferably is also arranged at a certain angle of inclination. Thus, the single pump 14 can be used to pump this sub-flow further, for instance to a special reject pump, in order to dilute the reject before it is pumped further.

Figure 3:
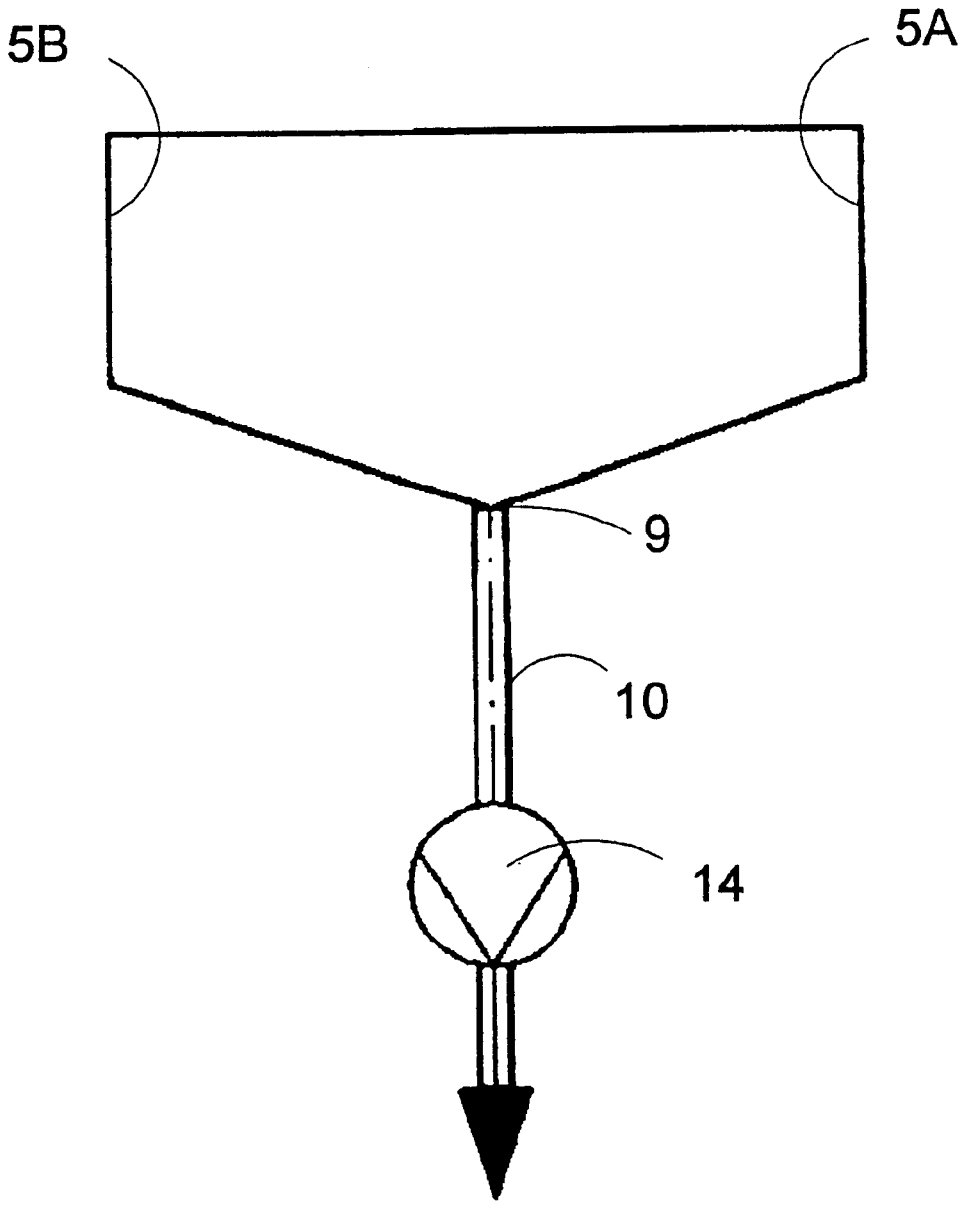
FIG. 3 shows a cross section through a white water channel according to the invention.

In FIG. 3 a cross section of a white water channel according to the invention is shown. As can be seen, the walls 5A, 5B are suitably vertically arranged and the bottom in transverse cross-section has a V-shaped configuration. Owing to the V-shaped configuration of the channel bottom, sediment will not only move towards the outlets in the flow direction but also inwardly towards the centerline of the channel, which makes it possible to use a rather limited size of the outlet and still manage to remove sediment. With this design it is possible to use a conventional conduit 10 at the additional outlet 9; the same principle is also applicable at the outlet 13.

The invention is not limited to what has been described above but can be varied within the scope of the appending patent claims. It should thus be understood that in principle a different number of bottom portions can be used to achieve the purpose of the invention. Further, it should be understood, that containers other than a silo 5 can be used to collect the white water. Further, it is contemplated that the sub-flows that are taken from the additional outlets preferably can be carried directly to devices other than a pump, for instance directly to a chest. It is also contemplated that a pump need not always be used to transport the liquid that has been drained through the outlet pipe (e.g., the conduit 10) but that a natural flow can advantageously be utilized in this connection. Persons skilled in the art will realize also that the advantages of the invention can be utilized even if the levels $H_1$ and $H_3$ are not equal. Similarly, the angles $\alpha_1$ and $\alpha_2$ need not be equal but such an arrangement in certain situations is preferred. Further, it is realized that the white water channel can be made of many different materials and combinations of different materials, such as concrete, plastics, metals, etc.

That which is claimed:

1. An arrangement for handling of white water from a paper machine comprising:

a white water outlet for discharging white water from the paper machine;

a white water silo for storing the white water discharged from the paper machine; and a white water channel having an inlet end connected to the white water outlet for receiving white water from the paper machine and an opposite outlet end defining a main outlet through which the white water is discharged into the white water silo, the channel having a channel bottom, the channel bottom sloping downward in a flow direction from the inlet end to the outlet end, wherein an additional outlet is provided between the main outlet and the inlet end, the bottom having a first bottom portion that leads away from the inlet end up to the additional outlet and a second bottom portion that leads away from the additional outlet toward the main outlet, the first and second bottom portions being so arranged in relation to each other that each of said bottom portions slopes downward in the flow direction at an angle of inclination that exceeds a critical angle of inclination that avoids sedimentation on the bottom.

2. The arrangement of claim 1, wherein the additional outlet is formed through the bottom of the channel.

3. The arrangement of claim 2, wherein the first bottom portion slopes downward from an upstream end to a downstream end thereof, and the additional outlet is located substantially at the downstream end of the first bottom portion.

4. The arrangement of claim 1, wherein the first bottom portion slopes downward from an upstream end to a downstream end thereof, the second bottom portion slopes downward from an upstream end to a downstream end thereof, and the upstream end of the second bottom portion is at a higher vertical level than the downstream end of the first bottom portion.

5. The arrangement of claim 4, wherein the upstream ends of the first and second bottom portions are at substantially the same vertical level.

6. The arrangement of claim 4, wherein the bottom of the channel further includes an intermediate bottom portion between the first and second bottom portions, the intermediate bottom portion sloping upward from a downstream side of the additional outlet to the upstream end of the second bottom portion.

7. The arrangement of claim 6, wherein the intermediate bottom portion has an angle of inclination larger than that of either of the first and second bottom portions.

8. The arrangement of claim 6, wherein the intermediate bottom portion has an angle of inclination substantially larger than that of either of the first and second bottom portions.

9. The arrangement of claim 8, wherein the angle of inclination of the intermediate bottom portion is between 5° and 60°.

10. The arrangement of claim 4, wherein each of the first and second bottom portions has an angle of inclination exceeding about 2°.

11. The arrangement of claim 4, wherein each of the first and second bottom portions has an angle of inclination exceeding about 2.5°.

12. The arrangement of claim 4, wherein each of the first and second bottom portions has an angle of inclination exceeding about 3°.

13. The arrangement of claim 1, wherein the bottom has a V-shaped configuration in transverse cross-section and wherein the additional outlet is located at a lowest point of the transverse cross-section.

14. The arrangement of claim 1, wherein the angles of inclination of the first and second bottom portions are approximately equal.

15. The arrangement of claim 1, wherein the bottom portion includes a third bottom portion following the second bottom portion and also sloping downward in the flow direction with an angle of inclination exceeding said critical angle of inclination, and wherein a second additional outlet is formed in the channel between the inlet end and the main outlet.

16. The arrangement of claim 15, wherein each of the second and third bottom portions has an upstream end that is at a higher vertical level than a downstream end of the first bottom portion.

17. The arrangement of claim 15, wherein each of the additional outlets is connected to a conduit, and a connecting conduit connects the conduit of one additional outlet to the conduit of the other additional outlet.

18. The arrangement of claim 17, wherein the connecting conduit slopes downward in a direction from the conduit of the one additional outlet to the conduit of the other additional outlet.

19. An arrangement for handling of white water from a paper machine, comprising:

a white water outlet for discharging white water from the paper machine;

a white water silo for storing the white water discharged from the paper machine; and a white water channel having an inlet end connected to the white water outlet for receiving white water from the paper machine and an opposite outlet end defining a main outlet through which the white water is discharged into the white water silo, the channel having a channel bottom, the channel bottom comprising a first bottom portion sloping downward in a flow direction from the inlet end to a downstream end of the first bottom portion located at a vertical level $H_2$, and a second bottom portion having an upstream end following the first bottom portion, the second bottom portion sloping downward in the flow direction, the upstream end of the second bottom portion being at a vertical level $H_3$ that exceeds the vertical level $H_2$, and wherein an additional outlet is provided between the first and second bottom portions.

* * * * *